United States Patent [19]

Weick

[11] 4,352,457

[45] Oct. 5, 1982

[54] DEVICE FOR LONG-TERM EVAPORATION OF PERFUMES

[76] Inventor: Heinz H. Weick, 94 rue de la Servette, 1202 Geneva, Switzerland

[21] Appl. No.: 191,331

[22] PCT Filed: Jun. 1, 1979

[86] PCT No.: PCT/CH79100081

§ 371 Date: Jan. 30, 1980

§ 102(e) Date: Jan. 30, 1980

[87] PCT Pub. No.: WO80/00003

PCT Pub. Date: Jan. 10, 1980

[30] Foreign Application Priority Data

| | | | |
|---|---|---|---|
| Jun. 2, 1978 | [CH] | Switzerland | 6038/78 |
| Dec. 23, 1978 | [CH] | Switzerland | 13066/78 |
| Mar. 21, 1979 | [CH] | Switzerland | 2627/79 |

[51] Int. Cl.[3] ..... A45D 34/00; A61L 9/12

[52] U.S. Cl. ..... 239/45; 239/47; 239/50; 239/51.5; 239/57

[58] Field of Search ..... 239/34, 36, 44–47, 239/49, 51.5, 53–59

[56] References Cited

U.S. PATENT DOCUMENTS

| | | | |
|---|---|---|---|
| 1,469,104 | 9/1923 | Ornduff | 239/57 X |
| 3,910,495 | 10/1975 | Cummings et al. | 239/58 |

FOREIGN PATENT DOCUMENTS

| | | | |
|---|---|---|---|
| 393633 | 12/1908 | France . | |
| 985173 | 7/1951 | France | 239/57 |
| 2043890 | 2/1971 | France | 239/45 |
| 45-9437 | 5/1970 | Japan . | |
| 46-18878 | 7/1971 | Japan . | |
| 50-42962 | 4/1975 | Japan . | |
| 51-8357 | 1/1976 | Japan . | |
| 367945 | 4/1963 | Switzerland | 239/36 |

*Primary Examiner*—Andres Kashnikow
*Attorney, Agent, or Firm*—Fleit & Jacobson

[57] ABSTRACT

A device for long-term evaporation of liquid perfumes, particularly for placing in the pockets of garments and handbags and equipped with a stand, comprising a flat, plate-like basic member which encloses a perfume carrier and which has at least one wall having an evaporation region made porous for evaporation purposes. The basic member is provided with a reserve perfume chamber which communicates with the evaporation chamber through at least one channel for the passage of perfume. A cover member is mounted on the basic member and movable thereon in the manner of a slide from a sealing position, in which the porous evaporation region is covered, to at least one evaporating position.

16 Claims, 12 Drawing Figures

DEVICE FOR LONG-TERM EVAPORATION OF PERFUMES

TECHNICAL FIELD

The invention relates to a device for long-term evaporation of liquid perfumes, for placing in the pockets of garments, in handbags and the like and equipped with a stand for use as a free standing evaporator. Within the said fields the invention concerns a device for long-term evaporation comprising a flat, plate-like basic member which encloses a perfume carrier and which has at least one wall made porous for evaporation purposes. The perfumes may equally be of a paramedicinal type, e.g. to act on the respiratory tracts.

STATE OF THE ART

Evaporators of the above type which have already been proposed in prior publications are accommodated in corsetry, bras, underarm pads and similar garments, which are provided with special pockets for the purpose. In one of these known constructions the container surrounding the perfume carrier is made of viscose sponge and contains a slot-like chamber into which is pushed a perfume capsule which is as shallow as a board and which has a capillary hole (Swiss Pat. No. 367945). The flexible container is surrounded by an elastic, perforated cover. Another proposal is for a perfume tablet of solid or semi-solid consistency to be accommodated directly in a bag provided with evaporation holes (Swiss Pat. No. 345432).

Because of their impractical construction and the arbitrary nature of their application these evaporators have never found acceptance.

DISCLOSURE OF INVENTION

The problem underlying the invention is to develop an evaporator of the above type so as to give it a novel form and construction, in which it is particularly convenient to manipulate, and so as to adapt it particularly for carrying in pockets which are provided in garments in any case, such as breast pockets of jackets, shirts and blouses, in inside jacket pockets and the like. A particularly large evaporation capacity must further be obtained, in addition, a simple appropriate development must provide for the evaporator to be used as a free-standing appliance.

The invention is characterised in that the basic member is provided with a second chamber which, in the form of a reserve scent chamber, communicates with the evaporation chamber by means of at least one channel for the passage of perfume, and in that a cover member, which is mounted on the basic member and movable thereon in the manner of a slide, can be transferred from a sealing position, in which the porous evaporation region is covered, to at least one evaporating position.

A further feature of the invention is that the cover member is in the form of a sheath-like sleeve which is provided with an inwardly directed engaging cam for the purpose of securing a plurality of adjustment positions, and that by virtue of the inherent resilience of the corresponding wall of the cover member, the engaging cam exerts a locking action in co-operation with a longitudinal row of evaporation openings in the basic member.

Wick-like perfume conductors are proposed to convey the liquid perfume from the reserve chamber into the evaporation chamber, the longitudinal portions of the conductors, which extend into the evaporation chamber, also acting as evaporating perfume carriers. Other features of the invention will emerge from the description of the drawings.

DESCRIPTION OF DRAWINGS

Some examples of the invention are illustrated in the accompanying drawings, in which.

Figure 1:
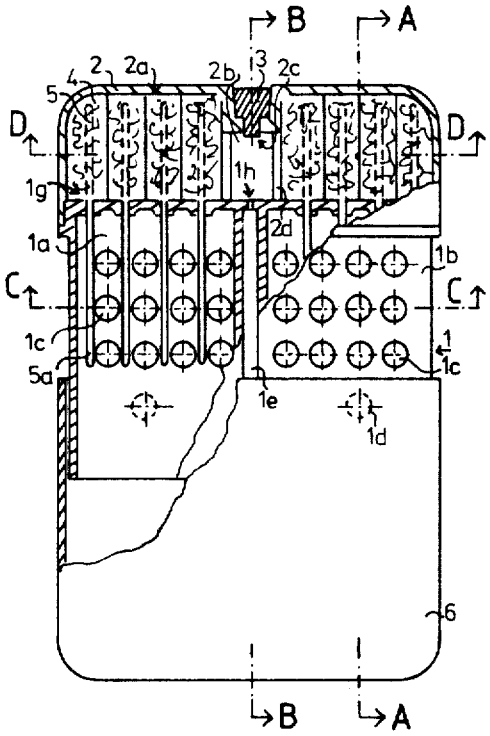
FIG. 1 is a side elevation of a first example, partly in section.
Figure 2:
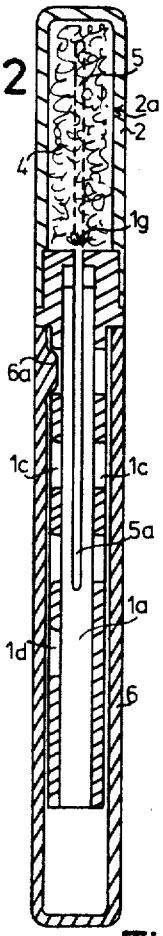
FIG. 2 is a section A—A in FIG. 1.
Figure 3:
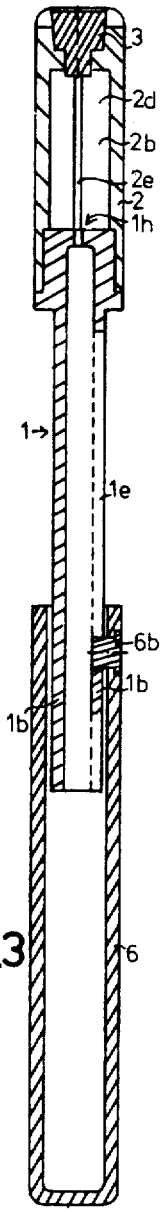
FIG. 3 is a section B—B in FIG. 1.
Figure 4:
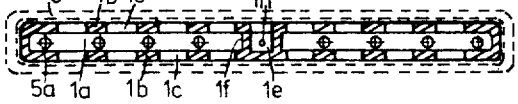
FIG. 4 is a section C—C in FIG. 1.
Figure 5:
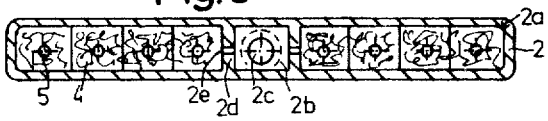
FIG. 5 is a section D—D in FIG. 1.
Figure 6:
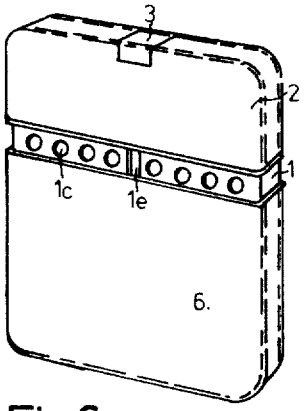
FIG. 6 is a perspective view in the first evaporating position.

The figures have been drawn on different scales in order to show the various constructional details with maximum clarity. On the other hand, the evaporating device in the embodiment for carrying in the pocket of a garment is of a size such that it fits e.g. into a small breast pocket of a shirt or blouse. For models supported exclusively on a stand size is of less importance.

In the examples shown in FIGS. 1 to 6 the basic member comprises the hollow panel 1 surrounding the evaporation chamber 1*a*, and the flat hollow body 2 which acts as a handle portion and also contains the reserve scent chamber 2*a*. These two components are fixed together by fluid-tight ultrasonic welding. The reserve scent chamber 2*a* is divided into two halves by a central replenishing chamber 2*b*, each half being filled with a plurality of tampons 4 of absorbent material enclosed in a sleeve shape. The two halves of the reserve scent chamber 2*a* are joined to the evaporating chamber 1*a* by channels 1*g* for the passage of perfume. Wick-like perfume conductors 5 lead through these channels. There are upper longitudinal regions extending to the tampons 4, while their lower portions extending into the evaporating chamber 1*a* also act as evaporating perfume carriers 5*a*. The replenishing chamber is bounded on both sides, in the direction of the two halves of the reserve scent chamber 2*a*, by the webs 2*d* with slits 2*e* for the passage of fluid between them. An outwardly directed filling aperture 2*c* for the replenishing chamber 2*b* is sealed by a removable plug 3. A pressure equalising aperture 1*h* leads from the replenishing chamber 2*b* to the evaporating chamber 1*a*. The two side walls 1*b* of the hollow panel 1 are provided with rows of openings 1*c* for evaporation.

The cover member 6 is in the form of a sheath like body 6 tightly enclosing the hollow panel 1. As a means of securing the arrangement in different adjusted positions it has two internal locking cams 6*a* in the region of its aperture, the cams interacting resiliently with corresponding rows of evaporation openings 1c by virtue of the elasticity of the side walls of the body. The tapered construction of the cams and corresponding evaporation openings 1c facilitates the locking and unlocking action. The engaging apertures 1d allow for a third evaporating position with all three transverse rows of evaporation openings 1c exposed. The uppermost or first engaged position is the closed position.

Since the locking means 1c, 6a described do not offer adequate security against complete removal of the cover member 6 from the hollow panel 1, a cylindrical abutment cam 6b is provided inside the cover member. The cam 6b is higher than the engaging cam 6a and engages in a longitudinal abutment groove 1e in the hollow panel 1. The groove is bounded by webs 1f at two opposing sides.

The longitudinal regions 5a of the perfume conductors 5 are at a certain distance from the side walls 1b of the hollow panel 1. This makes it impossible for the conductors to cause undesirable wetting of the said walls as a result of contact. To ensure that the perfume conductors 5 remain in this position they are in each case arranged between the longitudinal rows of evaporation openings 1c and thereby protected. In addition, the webs 1f of the hollow panel 1 guarantee the mutual spacing of the walls 1b.

The evaporator can be marketed in the filled state or empty. In the first case the abutment region between the basic member 1, 2 and the cover member 6 pushed into the closed position is sealed virtually hermetically by placing a self-sealing strip around it.

When the strip is subsequently removed by the user the evaporator is ready for immediate use.

When the cover member 6 has been set in one of the three possible evaporating positions according to the degree of evaporation desired, the evaporator is worn unobtrusively, e.g. in the breast pocket of a garment, with the handle portion 2 upwards. The quantity of scent evaporated from the longitudinal regions 5a of the perfume conductor 5 is constantly replenished from the reserve chamber 2a.

The absorbent filling material of the tampons 4 retains the fluid perfume and thereby counteracts excessive output of scent.

The pressure equalising aperture 1h fulfils the function of pressure equalisation required for the output of the scent. However, this is not its only purpose. It is also particularly important during a flight or a journey across mountains, if the evaporator suddenly reaches a higher altitude and thus comes under the influence of a lower atmospheric pressure, which may immediately also set up in the perfume reserve chamber 2a.

When the atmospheric pressure rises again equalisation takes place in the opposite direction.

As compared with known apparatus, this evaporator combines the following advantages:

- very flat construction which is unobtrusive to wear;
- multi-stage adjustment means which is simple to manipulate;
- direct use of liquid perfumes;
- particularly large capacity for evaporation owing to reserve scent chamber;
- provision for refilling.

To refill the evaporator the plug 3 is pulled out so that the replenishing chamber 2b can be filled with a pipette. The quantity of perfume added is subsequently slowly absorbed by the tampons 4 through the slits 2e. Instead of the closure 2c, 3 a self-closing valve may be provided, as in a refillable cigarette lighter, in which case the evaporator would be refilled in the manner known from cigarette lighters.

Figure 7:
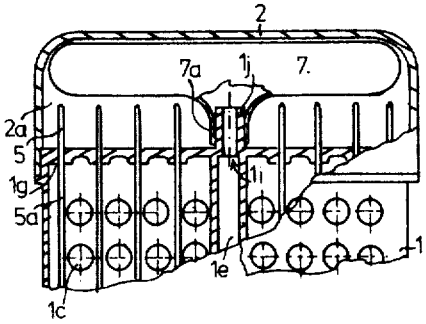
FIG. 7 is a partial side elevation, in section, of an evaporating device with a resilient pressure equalising member arranged in the perfume reserve chamber.

The modified embodiment shown in FIG. 7 is identical with the example previously described, apart from the pressure equalising means and the absence of any tampons 4. Components which are identical therefore carry the same references and will not be described again.

Equalisation of pressure is provided for by the pressure equalising member 7 in the top of the reserve scent chamber 2a. It is a thin-walled hollow member with rubber-like elasticity, which is joined to the stub-like projection 1j by the connecting neck 7a and which communicates with the atmosphere through the pressure equalising aperture 1h. The pressure equalising member 7 is thus externally under the pressure of the reserve scent chamber 2a, while atmospheric pressure prevails in the equalising member. The two pressures are normally approximately the same. If the evaporator should reach a higher elevation and thereby come under the influence of a lower atmospheric pressure, the excess pressure thereby produced in the reserve scent chamber 2a would act on the equalising member 7 from outside and decrease its volume, thereby bringing the pressure of the reserve chamber 2a to the atmospheric external pressure. This prevents any undesirable overdischarge of scent. When atmospheric pressure rises again equalisation takes place in the opposite direction.

Factory filling of the reserve scent chamber 2a may, for example, take place as follows:

Only seven of the eight perfume conductors 5 are initially inserted. A predosed quantity of liquid perfume is then injected through the eighth channel 1g by means of a pipette, and the channel is filled by inserting the eighth perfume conductor. This method of filling dispenses with any additional filling aperture. With this embodiment there is of course no possibility of subsequent refilling.

Figure 8:
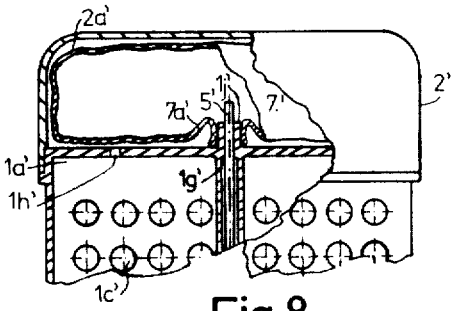
FIG. 8 is a similar view of an alternative to FIG. 7.

An alternative pressure equalising means to that in FIG. 7 is shown in FIG. 8. The reserve scent chamber 2a' of the handle portion 2' contains a bag-like flexible insert 7'. It is joined to the stub-like projection 1j' by its connecting neck 7a'. The projection 1j' contains channel 1g' for the passage of the scent, with the perfume conductor 5' extending through it. The longitudinal portion of the conductor extending into the evaporation chamber 1a' is again used for evaporation. The walls of the evaporation chamber 1a' contain evaporation openings 1c'. The pressure equalising aperture 1h' ensures that the outer walls of the bag-like insert 7' will be under atmospheric pressure. The bag 7' changes its three dimensional shape—that is to say, it becomes smaller relative to its contents—according to the quantity of perfume discharged and by virtue of its thin, sheeting-like wall, thereby solving the problem of air supply, which might otherwise be necessary. Differences in pressure arising from sudden changes of altitude are similarly compensated for immediately.

In this embodiment a plurality of perfume conductors could again be inserted (or one conductor of larger cross-section).

Figure 9:
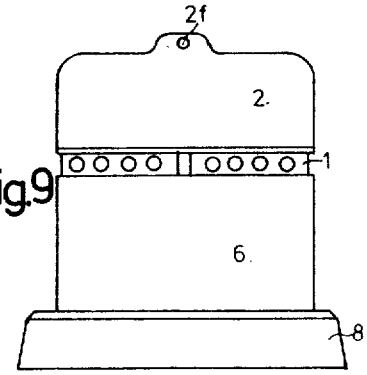
FIG. 9 is a side elevation of an evaporating device like that in the first example, provided with a separate stand.
Figure 10:
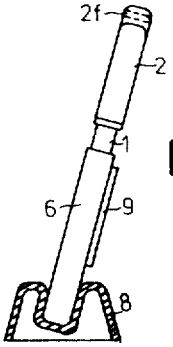
FIG. 10 is a side elevation of a narrow side in FIG. 9.

In the construction shown in FIGS. 9 and 10 the evaporator comprising components 1, 2 and 6 is provided with a separate socket-like stand 8.

The advantage of this further embodiment is that the evaporator can optionally either be carried in clothing or placed e.g. on a desk, bookshelf or the like. Thus two different applications are provided with minimum expense.

A hole 2*f* is formed in the top of the handle portion 2 to allow for a suspended arrangement e.g. in a motor vehicle. For fastening by adhesion the evaporator may be provided with an adhesive strip 9 or the like with a two-sided action. It is also possible to fit the evaporator with an attaching clip.

Figure 11:
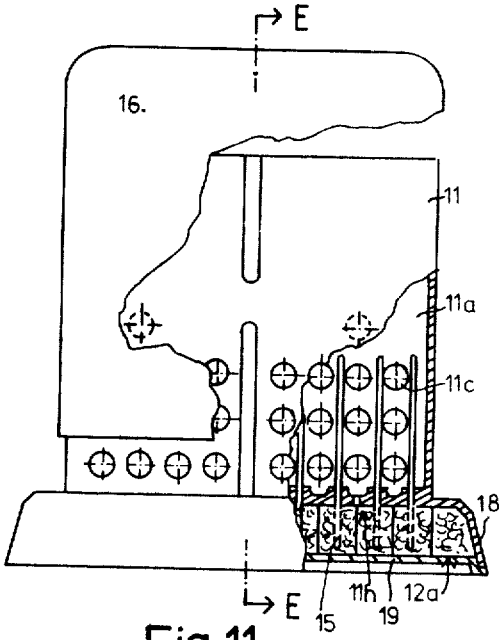
FIG. 11 is a part-sectional side elevation of a modified embodiment with the basic member and the stand constructed in one piece.
Figure 12:
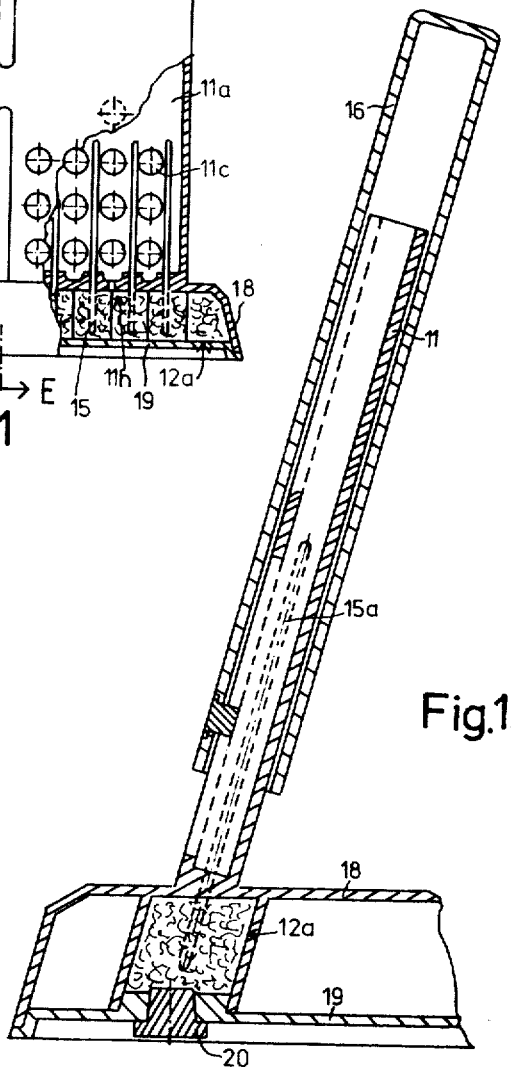
FIG. 12 is a section E—E in FIG. 11.

FIGS. 11 and 12 show that the evaporator may equally be provided with an integral stand 18. This is made in one piece with the hollow panel 11 surrounding the evaporating chamber 11*a*.

It will be noted that in this modified embodiment the position of use is reversed, in that the cover member 16 is now at the top while the reserve scent chamber 2*a* is arranged inside the stand 18. A pressure equalising aperture is shown at 11*h*. The reserve scent chamber 12*a* is sealed at the bottom by a cover 19, which is fixed by fluid-tight ultrasonic welding and which contains a screw closure 20 for refilling.

All the other constructional details, such as the scent, evaporation openings, engaging means and the like, correspond to those in the first example and will be understood without any further explanation.

I claim:

1. A device for long-term evaporation of liquid perfumes, particularly for placing in the pockets of garments and handbags, comprising a flat, plate-like basic member which encloses a perfume carrier and which has at least one wall having a porous evaporation region for evaporation purposes, the basic member 1, 2 being provided with a reserve perfume chamber 2*a*, an evaporation chamber 1*a*, and at least one channel 1*g* for establishing communication between the reserve chamber and the evaporation chamber for the passage of perfume, a cover member 6 mounted on the basic member 1, 2 and movable thereon in the manner of a slide between a sealing position, in which the porous evaporation region is covered, and at least one evaporating position, in which at least a portion of the porous evaporation region is uncovered, the cover member 6 being in the form of a sheath-like sleeve which is provided with an inwardly directed engaging cam 6*a* for the purpose of securing a plurality of evaporating positions, and by virtue of inherent resilience of the corresponding wall of the cover member, the engaging cam exerting a locking action in co-operation with a longitudinal row of evaporation openings 1*c* in the basic member 1, 2, the device including at least one wick-like perfume conductor 5 of compact, rod-like construction, extending through said channel 1*g* for the passage of perfume, a longitudinal portion 5*a* of the conductor 5 extending into the evaporation chamber 1*a* between front and rear walls 1*b* thereof and immediately acting as an evaporating perfume carrier, and the thickness of the conductor 5, relative to the internal spacing between front and rear walls 1*b* of the evaporation chamber 1*a*, being such as to prevent any mutual contact between the perfume conductor portion 5*a* and the walls 1*b*.

2. The device of claim 1, characterised in that the reserve perfume chamber 2*a* is filled with absorbent material 4, and any desired number of perfume conductors 5 are in contact with it.

3. The device of claim 1, characterised in that the reserve perfume chamber 2*a* communicates with the atmosphere through a small pressure equalising aperture 1*h*.

4. A device for long-term evaporation of liquid perfumes, particularly for placing in the pockets of garments and handbags, comprising a flat hollow member defining a first evaporation chamber which encloses a perfume carrier, and which has two large area-planar substantially parallel side walls (1*b*) having an evaporation region made porous or apertured for evaporation purposes, the flat member (1, 2) being provided with a second chamber (2*a*) to serve as a reserve perfume chamber which communicates with the evaporation chamber (1*a*), at least one channel (1*g*) for establishing communication between the first and the second chamber for the passage of perfume, a cover member (6) in the form of a sheath-like sleeve mounted on the flat member (1, 2) and movable thereon so as to slide between a sealing position in which the evaporation region is covered and at least one evaporation position in which the evaporation region is uncovered, and including at least one wick-like perfume conductor (5) of compact, rod-like, substantially rigid, construction, extending through said channel (1*g*) for the passage of perfume, a longitudinal portion (5*a*) of the conductor (5) extending into the hollow member between side walls (1*b*) thereof and immediately acting as an evaporating perfume carrier, and the perpendicular distances between the two large area-planar substantially parallel side walls (1*b*) and the longitudinal portion (5*a*) of the conductor (5) being sufficient to prevent mutual contact between the longitudinal portion (5*a*) and the walls (1*b*) and to provide the device with a flat shape.

5. The device of claim 4, characterised in that the cover member 6 interacts with a longitudinal abutting groove 1*e* in a wall 1*b* of the basic member by means of an internal abutting cam 6*b*.

6. The device of claim 4, characterised in that the device includes a stand 8, 18.

7. The device of claim 6, characterised in that the reserve perfume chamber of the basic member is incorporated in the stand.

8. The device of claim 6, characterised in that the stand 8 is in the form of a socket-type stand for the unit of equipment comprising the basic member 1, 2 and the cover member 6.

9. A device for long-term evaporation of liquid perfumes, particularly for placing in the pockets of garments and handbags, comprising a flat, plate-like basic member which encloses a perfume carrier and which has at least one wall having a porous evaporation region for evaporation purposes, the basic member 1, 2 being provided with a reserve perfume chamber 2*a*, an evaporation chamber 1*a*, and at least one channel 1*g* for establishing communication between the reserve chamber and the evaporation chamber for the passage of perfume, a cover member 6 mounted on the basic member 1, 2 and movable thereon in the manner of a slide between a sealing position, in which the porous evaporation region is covered, and at least one evaporating position, in which at least a portion of the porous evaporation region is uncovered, absorbent material 4 filling the reserve perfume chamber 2*a*, and a perfume conductor 5 in contact with the absorbent material 4 and extending between the reserve perfume chamber and the evaporation chamber.

10. The device of claim 9, characterised in that the absorbent filling material comprises a plurality of tampons 4 enclosed in a sleeve shape.

11. The device of claim 9, characterised in that the reserve perfume chamber 2*a* has a replenishing chamber 2b, which is separated by webs 2d from the space in the reserve perfume chamber 2a occupied by filling material 4, apart from at least one slit 2e for the passage of fluid, the replenishing chamber 2b having an outwardly directed refill aperture 2c that can be closed.

12. A device for long-term evaporation of liquid perfumes, particularly for placing in the pockets of garments and handbags, comprising a flat, plate-like basic member which encloses a perfume carrier and which has at least one wall having a porous evaporation region for evaporation purposes, the basic member 1, 2 being provided with a reserve perfume chamber 2a, an evaporation chamber 1a, and at least one channel 1g for establishing communication between the reserve chamber and the evaporation chamber for the passage of perfume, a cover member 6 mounted on the basic member 1, 2 and movable thereon in the manner of a slide between a sealing position, in which the porous evaporation region is covered, and at least one evaporating position, in which at least a portion of the porous evaporation region is uncovered, and a small pressure equalizing aperture 1h communicating the reserve perfume chamber 2a with the atmosphere.

13. A device for long-term evaporation of liquid perfumes, particularly for placing in the pockets of garments and handbags, comprising a flat, plate-like basic member which encloses a perfume carrier and which has at least one wall having a porous evaporation region with rows of evaporation openings 1c extending longitudinally for evaporation purposes, the basic member 1, 2 being provided with a reserve perfume chamber 2a, an evaporation chamber 1a, and a plurality of channels 1g for establishing communication between the reserve chamber and the evaporation chamber for the passage of perfume, a cover member 6 mounted on the basic member 1, 2 and movable thereon in the manner of a slide between a sealing position, in which the porous evaporation region is covered, and at least one evaporating position, in which at least a portion of the porous evaporation region is uncovered, a plurality of wick-like perfume conductors 5 extending through the channels 1g for the passage of perfume, each of the conductors 5 having a longitudinal portion 5a extending into the evaporation chamber 1a and acting immediately as an evaporating perfume carrier, the perfume conductors 5 being in a rod-like arrangement and consisting of man-made fibres, the longitudinal portions 5a thereof—as seen in a broadside view of the basic member 1, 2—extending into the evaporation chamber 1a between two rows of evaporation openings 1c.

14. The device of claim 13, characterised in that the vertical spacing between broadside walls 1b of the evaporating chamber 1a is stabilised by at least one web 1f midway along the length, and that the distance between the perfume conductors 5 and the said broadside walls 1b is such as to prevent any mutual contact.

15. A device for long-term evaporation of liquid perfumes, particularly for placing in the pockets of garments and handbags, comprising a flat, plate-like basic member which encloses a perfume carrier and which has at least one wall having a porous evaporation region for evaporation purposes, the basic member 1, 2 being provided with a reserve perfume chamber 2a, an evaporation chamber 1a, and at least one channel 1g for establishing communication between the reserve chamber and the evaporation chamber for the passage of perfume, a cover member 6 mounted on the basic member 1, 2 and movable thereon in the manner of a slide between a sealing position, in which the porous evaporation region is covered, and at least one evaporating position, in which at least a portion of the porous evaporation region is uncovered, and a resilient member 7 for establishing a pressure equalizing relationship between the reserve perfume chamber 2a and the external atmosphere.

16. The device of claim 15, characterised in that the resilient pressure equalising member 7 is in the form of a flexible hollow body accommodated in the reserve perfume chamber 2a, with its interior communicating with the atmosphere through a pressure equalising aperture 1i in the reserve chamber 2a.

* * * * *